United States Patent [19]

Staro

[11] Patent Number: 4,549,596

[45] Date of Patent: Oct. 29, 1985

[54] DEVICE FOR TENSIONING MATERIAL ON FRAMES

[76] Inventor: Giorgio Staro, Via Besso 44, 6900 Lugano, Switzerland

[21] Appl. No.: 523,882

[22] Filed: Aug. 17, 1983

[30] Foreign Application Priority Data

Sep. 2, 1982 [CH] Switzerland ..... 5209/82

[51] Int. Cl.[4] ..... G09F 1/12; A47G 1/00

[52] U.S. Cl. ..... 160/374.1

[58] Field of Search ..... 160/374.1, 376, 377; 40/155, 156; 38/102.4, 102.5, 102.7, 374.1

[56] References Cited

U.S. PATENT DOCUMENTS

| | | | |
|---|---|---|---|
| 1,562,153 | 11/1925 | Elbern | 160/374.1 |
| 1,771,039 | 7/1930 | Hedglon | 40/155 X |
| 3,625,274 | 12/1971 | Johnson | 160/374.1 |
| 4,006,771 | 2/1977 | Spurkel | 160/378 |
| 4,319,420 | 3/1982 | Clinton | 40/156 |

FOREIGN PATENT DOCUMENTS

| | | |
|---|---|---|
| 122640 | 6/1900 | Fed. Rep. of Germany . |
| 581549 | 7/1933 | Fed. Rep. of Germany . |
| 2028427 | 9/1970 | France . |
| 2197346 | 12/1974 | France . |
| 2324923 | 4/1977 | France . |
| 2439683 | 5/1980 | France . |
| 935183 | 12/1972 | Italy . |

*Primary Examiner*—Peter M. Caun
*Assistant Examiner*—Cherney S. Lieberman
*Attorney, Agent, or Firm*—Young & Thompson

[57] ABSTRACT

A frame for stretching artists' canvases comprises hollow sections (1, 2), in the recesses of which are inserted an insert (3, 3') that forms an angle at the corners. Each insert has a notch (4, 4') in which the bent end of a square spring (5, 5') fits. The spring is solid at the other end with a block (6, 6') that can slide in a guide (1', 2') and is provided with a tension screw (7, 7'). By the screw being tightened, the sections (1, 2) are thrust outward, leaving a space (10) between them, and causing the stretching of the canvas.

5 Claims, 4 Drawing Figures

DEVICE FOR TENSIONING MATERIAL ON FRAMES

This invention has as its object a frame to give the correct adjustable tension, with automatic compensation of the dimensional deformations in use, of works of art on canvas and for other uses.

Frames for these purposes are already known, for example, Italian Pat. No. 935,183, but the means used make the frame bulky, impractical, slow in putting to use and not very attractive.

The frame according to this invention completely eliminates the drawbacks mentioned above.

It is characterized by sections of hollow shape that are provided with an outside sliding channel and at whose ends are introduced, with play, connecting inserts and means to cause the relative outward micrometric expansion movement, elastically opposed, of said sections with respect to said connecting inserts.

According to a preferred embodiment, each of said means for causing the micrometric movement comprises a plate that can be inserted in the outside sliding channel of the section, a plate that is provided at one end with a square spring whose free end fits into a notch of the corresponding section, while a screw that can be tightened in said plate makes it possible to put the spring under tension, causing the relative outward micrometric expansion movement of the section with respect to the insert.

The accompanying drawings represent said preferred embodiment which is not limiting or binding.

Figure 1:
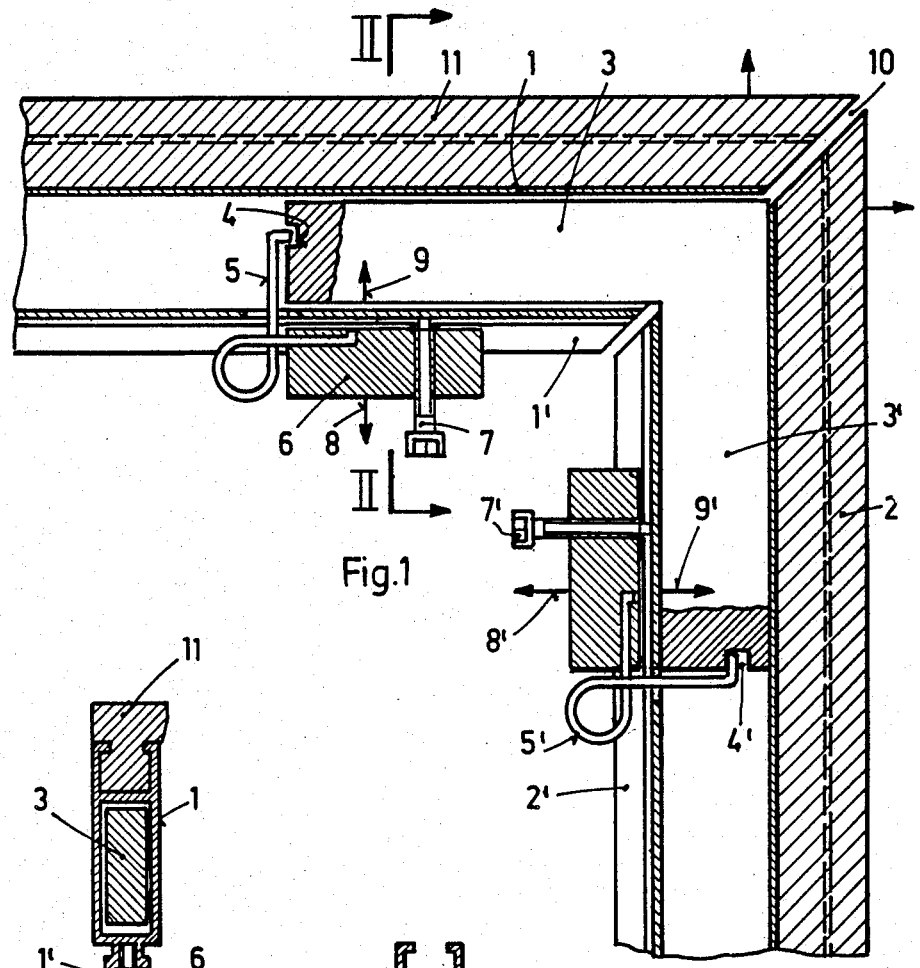
FIG. 1 represents in lengthwise section the frame only at its corner.
Figure 2:
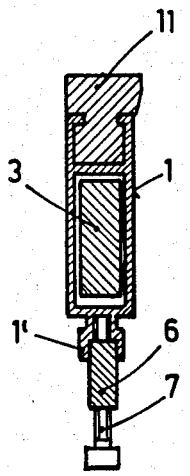
FIG. 2 represents a cross section along the plane passing through II—II in FIG. 1.

With reference to FIG. 1, the frame comprises, at a corner, two sections 1, 2 joined by a square insert 3, 3' which is disposed in a central recess of the frame (see also the cross section of FIG. 2).

Said insert exhibits, at each end, a notch 4, (4'), able to receive the square-bent end of spring 5, (5'), while the other end is solid with block 6, (6').

Block 6 (or 6') can slide in the lower recess 1' (or 2') of the section 1 (2) to make the bent end of corresponding spring 5 (5') go into notch 4 (4') of square insert 3 (3').

By screw 7 (7') being tightened, spring 5 (5') tends to drag insert 3 (3') in the direction of arrow 8 (8'), while in reaction the section 1 (2) moves in the direction of arrow 9 (9') causing a space 10 to be formed at the ends of the two sections 1 and 2, which has the effect of stretching the canvas placed on peripheral cornice 11 (FIG. 2) made of wood or other material, thus giving the correct tension to the canvas itself.

During use, which can be several years or even centuries (since paintings are involved), the dimensional deformations of the canvas are automatically compensated by springs 5 and 5' so that the canvas is always perfectly stretched to the correct value.

Figure 3:
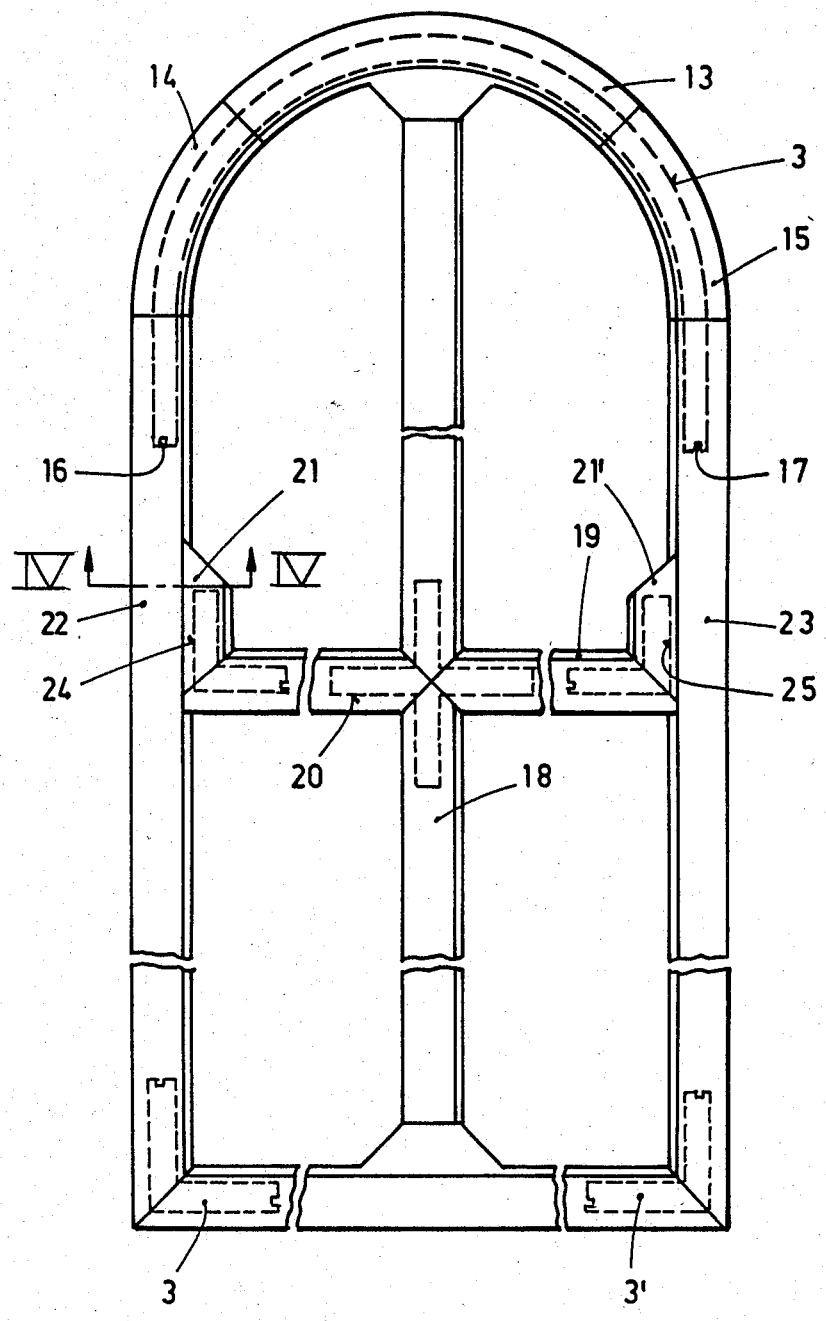
FIG. 3 represents the complete frame that can be used for a canvas with a semicircular upper part that is reinforced by central shapes in the form of a cross.

FIG. 3 shows the frame according to the invention complete with all its parts and suitable for a canvas that has a semicircular upper part.

For this purpose, upper insert 3, indicated by the broken line, has a semicircular shape, and segmented sections 13, 14, 15 are fitted on it and perform the same function as the straight sections 1 and 2 shown in FIG. 1.

Notches 16, 17 receive the square-bent end of the springs like 5 and 5' of FIG. 1, solid with the corresponding blocks like 6 and 6' of FIG. 1 in which screws like 7, 7' (means not shown in FIG. 3 for simplicity) are tightened.

Similarly, square inserts 3, 3' at the lower corners of the frame are like those shown in FIG. 1.

If the frame is large, shapes 18, 19 in form of a cross, with the corresponding insert 20 also cross-shaped, give the unit greater strength.

Figure 4:
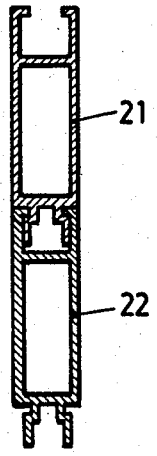
FIG. 4 represents a cross section along the line IV—IV of FIG. 3.

Two additional sections 21, 21' should be noted which are fitted in and slide in peripheral sections 22, 23 as is clearly shown in section in FIG. 4.

In this case, square inserts 24 and 25 provide for connecting with the central part of the frame.

Sections 1, 2, etc., shown in FIG. 1, are preferably of aluminum or aluminum alloy as are also inserts 3, 3' of the blocks and the other parts shown in FIG. 3.

But they can also be made of plastic or other material.

The frames that can be made according to the invention are very varied and it is understood that all of them come within the limits of the protection of the invention.

I claim:

1. Device for tensioning materials on frames, comprising a pair of elongated hollow sections disposed at an angle to each other, an insert having two legs, one leg being disposed within one of said sections and the other leg being disposed within the other of said sections, a spring at each end of said insert, each spring having one leg that extends within the associated said section and bears against one end of the insert and another leg extending outside said associated section, and means acting between said another leg and said associated section to stress the spring to cause said one leg to press against said end of said insert, and at the same time said means pressing against said associated section so as to urge said sections apart from each other in a direction transverse to their length.

2. Frame as claimed in claim 1, in which said spring is a torsion spring having its legs disposed at right angles to each other, said legs being interconnected by a loop of the material of the spring.

3. Device as claimed in claim 1, and a recess in each end of said insert, in which recess a bent over portion of each said one leg of the spring is disposed.

4. Device for tensioning materials on frames, comprising a pair of elongated hollow sections disposed at an angle to each other, an insert having two legs, one leg being disposed within one of said sections and the other leg being disposed within the other of said sections, a spring at each end of said insert, each spring having one leg that extends within the associated said section and bears against one end of the insert and another leg extending outside said associated section, and means acting between said another leg and said associated section to stress the spring to cause said one leg to press against said end of said insert, and at the same time said means pressing against said associated section so as to urge said sections apart from each other in a direction transverse to their length, said means comprising a block having a screw that passes in screw-threaded engagement through said block and bears against said associated section.

5. Device as claimed in claim 4, and means mounting said block for sliding movement along said associated section.

* * * * *